United States Patent [19]

Ames et al.

[11] 4,440,389

[45] Apr. 3, 1984

[54] SHEET REGISTRATION DEVICE

[75] Inventors: Jack D. Ames, Irving; David W. Smith, Richardson, both of Tex.

[73] Assignee: The Mead Corporation, Dayton, Ohio

[21] Appl. No.: 355,974

[22] Filed: Mar. 8, 1982

[51] Int. Cl.[3] ..... B65H 9/16

[52] U.S. Cl. ..... 271/251; 271/276

[58] Field of Search ..... 271/251, 275, 264, 276, 271/197

[56] References Cited

U.S. PATENT DOCUMENTS

| | | | |
|---|---|---|---|
| 1,728,328 | 9/1929 | Broadmeyer . | |
| 1,728,329 | 9/1929 | Broadmeyer . | |
| 2,190,418 | 2/1940 | Davidson et al. . | |
| 2,772,880 | 12/1956 | Garrett . | |
| 3,218,064 | 11/1965 | Davidson, Jr. et al | 271/275 |
| 3,405,935 | 10/1968 | MacNeill | 271/276 |
| 3,550,933 | 12/1970 | Wilson . | |
| 3,595,565 | 7/1971 | Bergland . | |
| 3,703,626 | 11/1972 | Shamrock | 235/61 |
| 3,942,788 | 3/1976 | Boyle | 271/250 |
| 4,125,255 | 11/1978 | Stovall et al. | 271/251 |
| 4,147,339 | 4/1979 | Shiina | 271/7 |
| 4,184,673 | 1/1980 | Weisbach | 271/237 |

*Primary Examiner*—Bruce H. Stoner, Jr.
*Assistant Examiner*—Lisa M. Rosenberg
*Attorney, Agent, or Firm*—Biebel, French & Nauman

[57] ABSTRACT

A sheet registration device for receiving a sheet from a sheet input and delivering the sheet to a sheet output, while laterally aligning the sheet prior to delivery to the sheet output, includes an endless belt conveyor which extends between the sheet input and the sheet output, and an alignment surface extending generally parallel to and to one side of the conveyor. An alignment arrangement, including a plurality of parallel vacuum belts and a cooperating plenum, is positioned adjacent the conveyor and is skewed with respect to the conveyor. The alignment arrangement engages a sheet as it is carried by the conveyor and transports the sheet laterally such that a lateral edge of the sheet contacts the alignment surface. The vacuum belts define relatively large openings through which the partial vacuum from the plenum is applied, such that the vacuum belts effectively engage a sheet only during periods in which substantially all of the openings are covered by the sheet.

8 Claims, 9 Drawing Figures

SHEET REGISTRATION DEVICE

BACKGROUND OF THE INVENTION

The present invention relates to a sheet registration device and, more particularly, to such a device which receives a sheet at a sheet input, laterally aligns the sheet, and then delivers it to a sheet output. Such devices may find particular application in printing and duplicating systems where sheets of copy paper are sequentially supplied to a printing station. The sheets are typically supplied from a tray containing a stack of sheets. The sheets in the stack are not precisely aligned with respect to the sheet feed mechanism and typically some amount of slippage between the sheets and feed rollers may occur as the sheets are withdrawn from the stack. As a consequence, the sheets may be somewhat misaligned laterally as well as being slightly skewed.

In order to shift a sheet laterally and align the sheet properly, a number of different sheet registration devices have been developed Broadmeyer U.S. Pat. No. 1,728,328 discloses a conveyor including a plurality of bars which support a sheet. A registration surface is positioned to one side of the bars, and the lateral edge of the sheet is urged against this surface. To accomplish this, a series of vacuum rollers which are skewed slightly with respect to the conveyor are positioned along the conveyor. The vacuum rollers translate the sheet along the bars and, at the same time, move it laterally into contact with the registration surface. Since the skewed vacuum rollers provide the sole means of movement of the sheets along the bars, the sheets are continuously urged against the registration surface. As a result, the lateral edge of the sheet may curl upward along the registration surface, producing a sheet which is improperly aligned.

Broadmeyer U.S. Pat. No. 1,728,329 discloses a conveyor having a plurality of moving endless belts and a single vacuum roller which is skewed with respect to the direction of movement of the belt conveyor. The vacuum roller provides lateral movement of a sheet carried by the belt conveyor such that the sheet edge contacts a registration surface.

Providing a belt conveyor as the primary sheet delivery mechanism, with the separate vacuum roller used for lateral alignment, reduces the possibility that the edge of the sheet contacting the registration surface will curl. Nevertheless, the Broadmeyer '329 device provides for application of a lateral shifting force to a sheet for the entire time which it takes the sheet to pass over the vacuum roller. As a consequence, there may still be a tendency for a relatively thin, flexible sheet to be moved too far laterally, past the point at which the lateral edge of the sheet merely contacts the registration surface. Additionally, since a single vacuum roller is used to provide lateral shifting of a sheet, during the times in which the roller engages generally the forward or trailing portions of the sheet, the roller may apply a force to the sheet which tends to rotate it, as well as shift it laterally.

Weisbach U.S. Pat. No. 4,184,673 and Garrett U.S. Pat. No. 2,772,880 both disclose vacuum belt arrangements in which the belts are skewed with respect to the principal direction of movement of a sheet in order to shift the sheet laterally for alignment. The Garrett '880 patent discloses a sheet stacker in which overlapping sheets are shifted laterally into contact with a pair of perpendicular alignment surfaces, while the Weisbach '673 patent discloses a device which shifts each sheet of an overlapping set laterally prior to feeding the sheet to a printer. The angular shifting of the sheets in both of these devices produces a series of overlapping or shingled sheets having two orthogonal edges exposed for abutment against alignment surfaces.

It is seen, therefore, that a relatively simple, reliable sheet alignment device is needed which is capable of receiving a sheet at a sheet input and transporting it to a sheet output, while at the same time aligning the sheet by bringing it into contact with a registration surface. Lateral movement of the sheet into contact with the surface should preferably be provided only for a period of time sufficient to cause such contact to occur.

SUMMARY OF THE INVENTION

A sheet registration device for receiving a sheet from a sheet input, laterally aligning the sheet, and delivering it to a sheet output, includes an endless belt conveyor means which extends between the sheet input and the sheet output. The conveyor means includes a plurality of endless belts. An alignment surface extends generally parallel to and to one side of the belts. A drive means is provided for driving the endless belt conveyor means, such that a sheet, supplied to the endless belt conveyor means from the sheet input, is carried by the belts to the sheet output. An alignment means includes a plurality of parallel vacuum belts and a cooperating plenum and is positioned adjacent the endless belt conveyor means and skewed with respect to the endless belts. The alignment means engages a sheet as it is carried by the endless belt conveyor means and transports the sheet laterally such that a lateral edge thereof contacts the alignment surface. A means is provided for supplying a partial vacuum to the plenum.

The plurality of parallel vacuum belts may be skewed approximately 30° with respect to the endless belts. The alignment means may further include a plurality of spherical rollers, and means for retaining the spherical rollers in a position above the vacuum belts so as to press a sheet carried by the conveyor means against the vacuum belts.

The endless belt conveyor means may further comprise a plurality of spherical rollers, and means for retaining the spherical rollers in a position above the endless belts so as to press a sheet carried by the conveyor means against the endless belts.

The vacuum belts may define a plurality of openings through which a partial vacuum from the plenum is applied to a sheet supported thereon. The openings are sufficient in size such that a sheet is not engaged unless the sheet is supported by all of the vacuum belts.

The drive means may include means for driving the plurality of parallel vacuum belts at a surface velocity greater than the surface velocity of the endless belts.

Accordingly, it is an object of the present invention to provide a sheet registration device which includes a conveyor, an alignment surface to one side of the conveyor, and an alignment means including a vacuum belt transport which shifts a sheet carried by the conveyor into contact with the alignment surface; to provide such a device in which the alignment means includes a plurality of parallel vacuum belts and a plurality of vacuum plenums, each plenum cooperating with a respective one of the belts and interconnected to the others of the plenums; to provide such a device in which the vacuum openings are sized such that substantial vacuum is applied to a sheet only when substantially all of the openings are covered by a sheet, whereby a sheet is engaged by the alignment means for a predetermined period of time, which time may be substantially less than the time required for a sheet to be completely transported past the alignment means.

Other objects and advantages of the invention will be apparent from the following description, the accompanying drawings and the appended claims.

DETAILED DESCRIPTION OF THE PREFERRED EMBODIMENT

Figure 1:
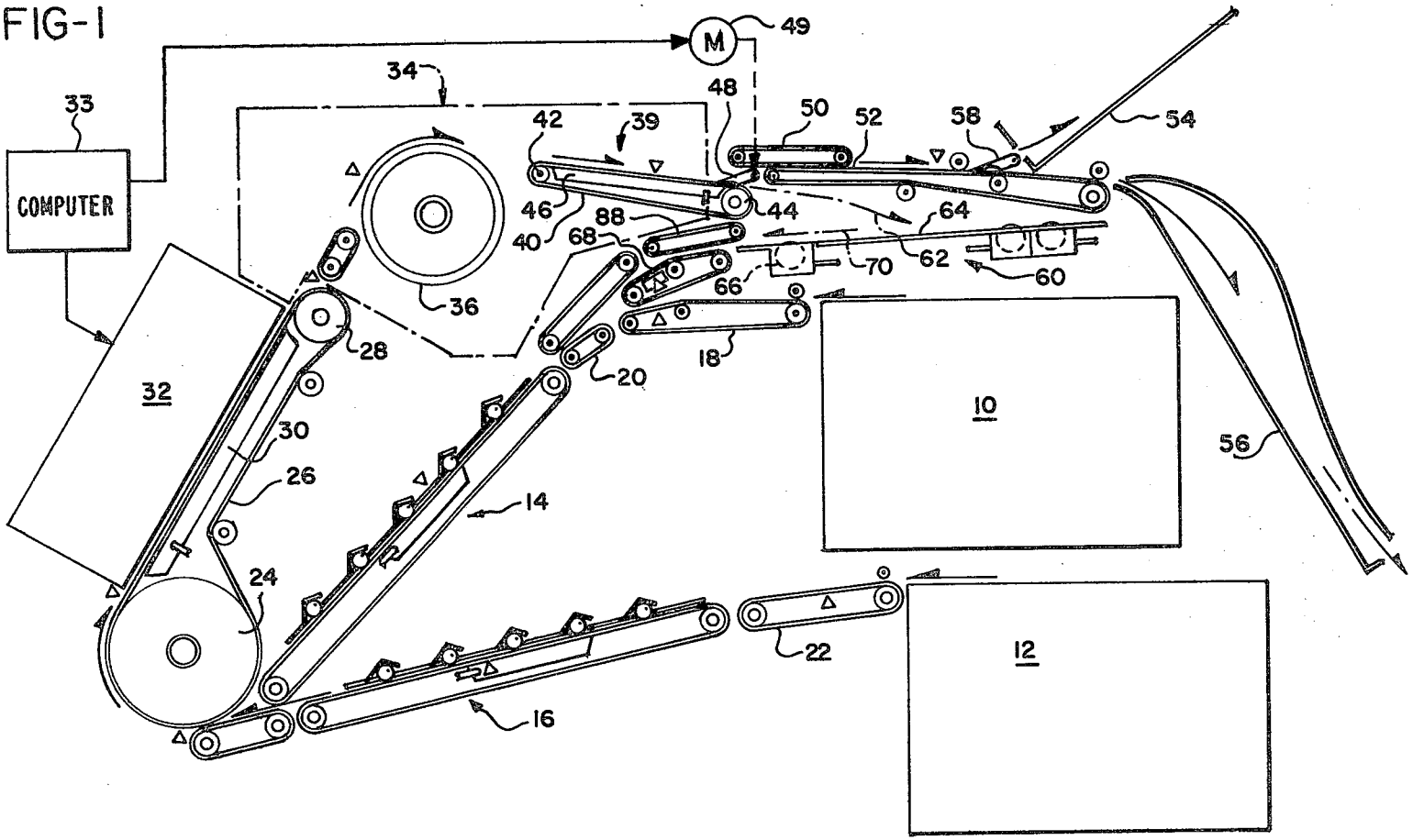
FIG. 1 is a side view, illustrating a printing system of the type with which the sheet registration device of the present invention may be utilized.

FIG. 1 is a schematic representation of a printer incorporating a pair of sheet registration devices constructed according to the present invention. Paper supply stations 10 and 12 provide blank sheets of paper to the sheet registration devices 14 and 16, respectively. Sheets of paper from supply station 10 are supplied to sheet registration device 14 via belt transports 18 and 20, while sheets from supply station 12 are transported to sheet registration device 16 by belt transport 22. The sheets are shifted laterally as they are transported through registration devices 14 and 16, as described more completely below, to provide proper lateral alignment prior to presentation of the sheets to a vacuum drum 24. Belts 26 extend around drum 24 and roller 28 and pass over vacuum plenum 30. The sheets are carried on the belts 26 past printer 32, which advantageously may be an ink jet printer. Printer 32 is controlled by print control signals from computer 33. Alternatively, printer 32 may receive print control signals from another source of control signals, such as, for example, from a document scanner which scans an original document simultaneously with the printing operation. Computer 33 may further monitor the movement of sheets through the system by means of photosensors spaced along the sheet path.

After printing on a first side of a sheet, the sheet is delivered to a drying station 34 where the ink is dried. The sheet is then delivered to a transport 39 which includes vacuum belts 40. Belts 40 extend around rollers 42 and 44, and a vacuum plenum 46 to which a partial vacuum is applied. In the case of sheets which are to be printed in a simplex mode, that is, printed only on one side, these sheets are removed from belts 40 by gate 48 which is pivoted downward, into the position shown in FIG. 1, by actuator 49. Gate 48 strips the sheets from belt 40 and delivers them to a conveyor mechanism, including belts 50 and 52, which carries the sheets to an output sample tray 54 or; alternatively, to an accumulator tray 56. Gate 58 deflects the sheets into tray 54, when pivoted into the position shown in FIG. 1.

If the second side of a sheet is to be printed to produce a duplex copy having print images on both of its sides, the sheet is supplied to sheet inverter 60, as indicated by arrow 62, such that the sheet is received on a sheet supporting surface 64. The sheet is then engaged by a reversal drive means including drive rollers 66, and moved toward belts 68, as indicated by arrow 70.

Next, the inverted sheet is transported through the sheet registration device 14 where it is again laterally aligned. At this point the side of the sheet which was previously printed contacts drum 24 and belts 26. The sheet is transported around the drum 24 and makes a second printing pass beneath ink jet printer 32. It will be appreciated that, during this second pass, the second unprinted side of the sheet is facing the printer and a print image may be printed thereon. After the second side of the sheet is printed, the sheet passes through the dryer section 34 and is subsequently delivered either to sample copy tray 54 or output accumulator tray 56.

Reference is now made to FIGS. 2–5 which illustrate in greater detail the sheet registration device of the present invention, and the manner in which it operates to provide lateral alignment of sheets passing therethrough. As shown in FIG. 2*a,* a sheet 72 is received from a sheet input, indicated generally at 74. A sheet is supplied to the input 74 by a belt conveyor or other sheet feed mechanism. The sheet is to be delivered to a sheet output, indicated generally at 76, and properly aligned laterally with its side edges parallel to the direction of sheet movement, as illustrated in FIG. 4*a.*

Figure 2A:
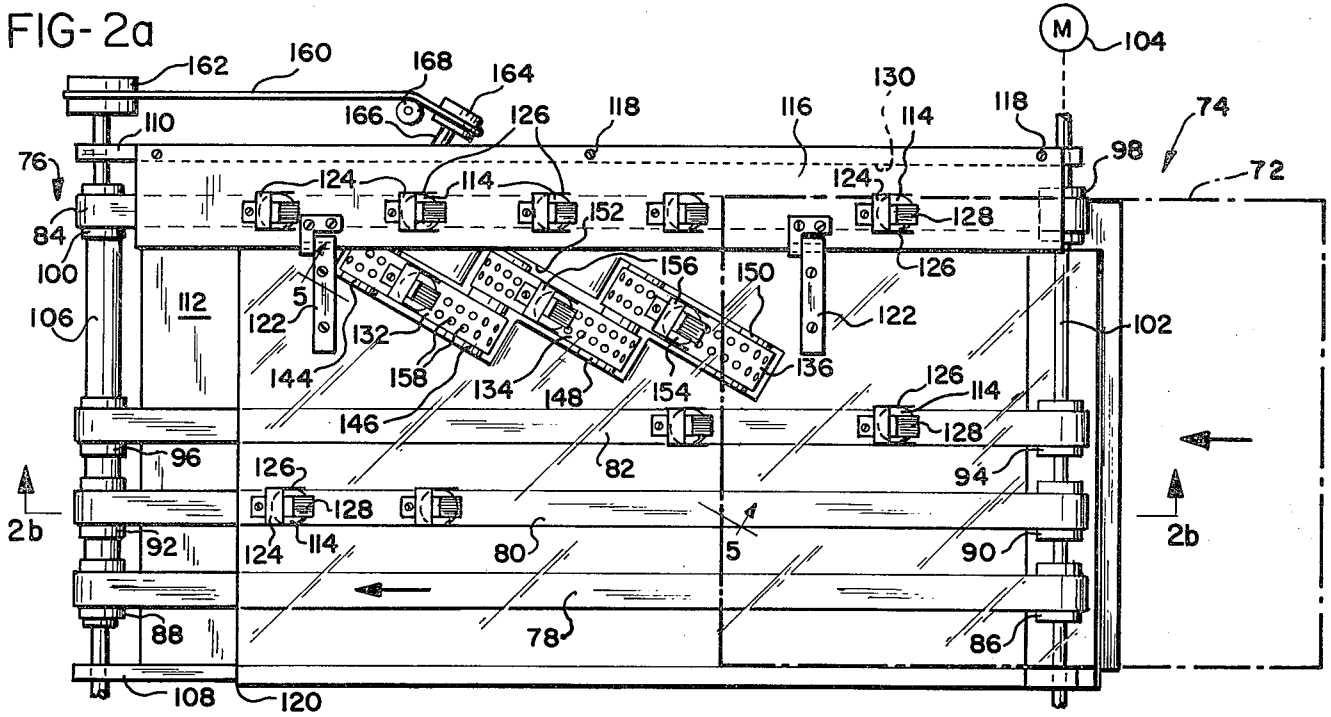
FIG. 2*a* is a plan view of the sheet registration device of the present invention.
Figure 2B:
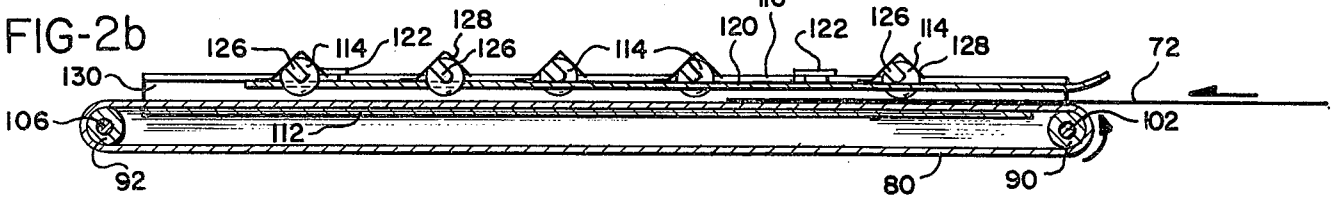
FIG. 2*b* is a sectional view taken generally along line 2—2 in FIG. 2*a;*
Figure 3A:
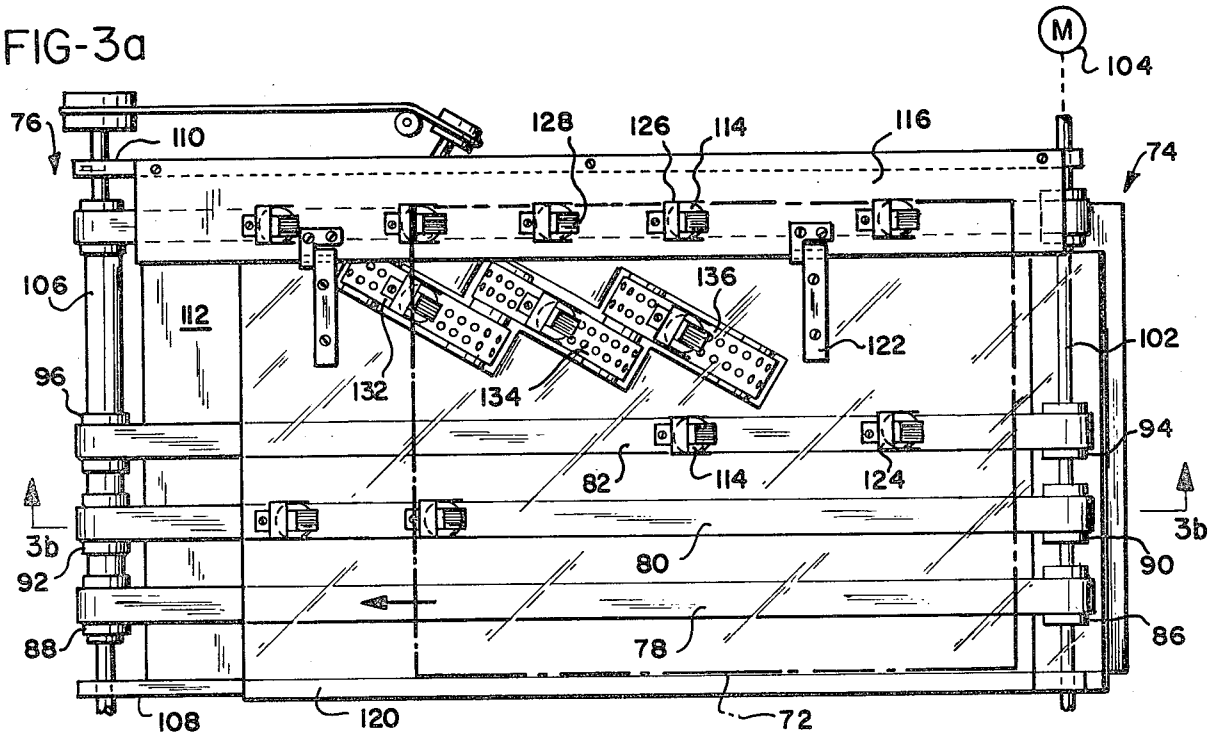
FIG. 3*a* is a plan view, similar to FIG. 2*a,* illustrating the movement of a sheet into the registration device.
Figure 3B:
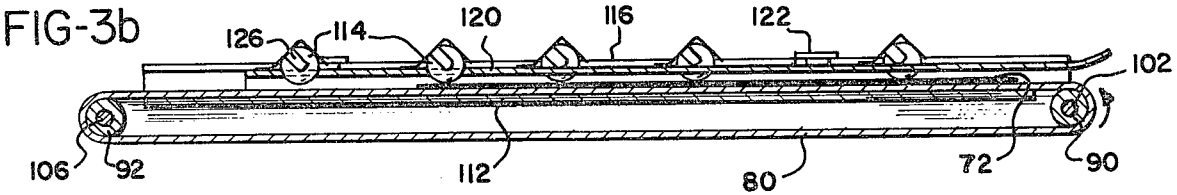
FIG. 3*b* is a sectional view taken generally along line 3—3 in FIG. 3*a;*
Figure 4A:
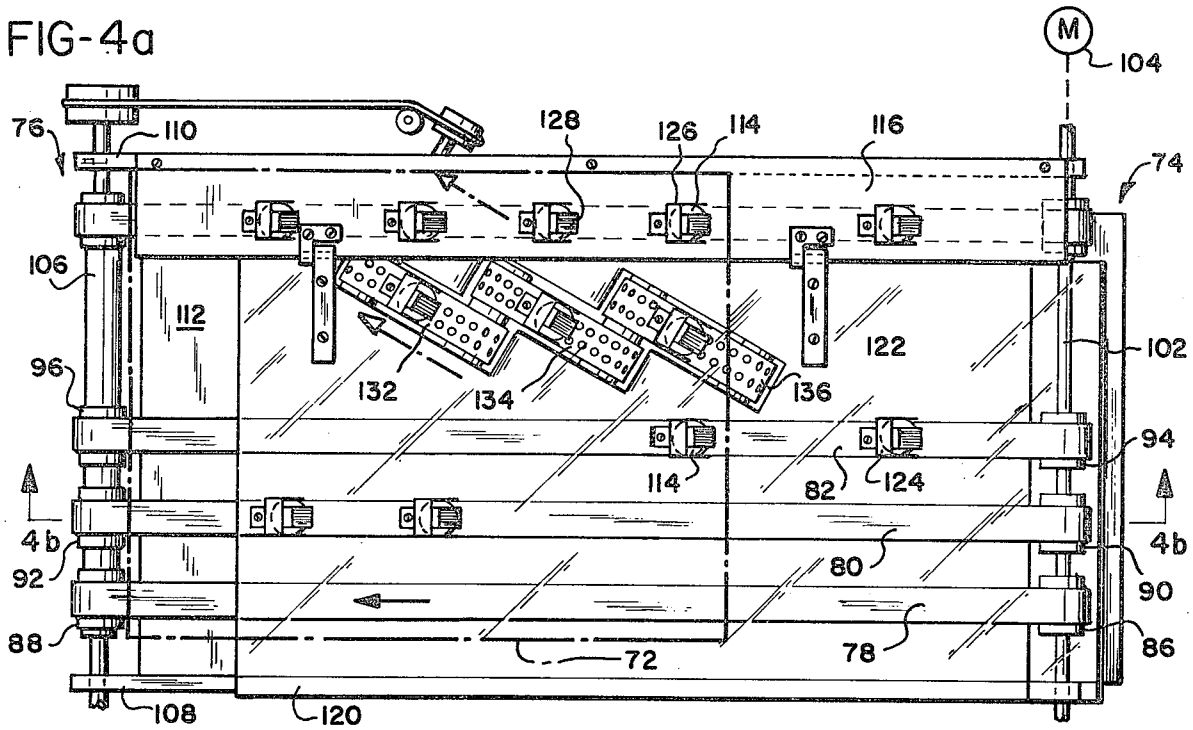
FIG. 4*a* is a plan view of the registration device, illustrating the movement of a sheet into contact with the registration surface.
Figure 4B:
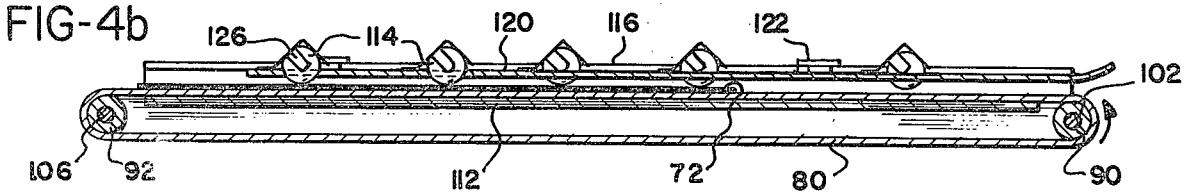
FIG. 4*b* is a sectional view taken generally along line 4—4 in FIG. 4*a;*

The primary means of transport of sheet 72 from the sheet input 74 to the sheet output 76 is by means of an endless belt conveyor means, including a plurality of endless belts 78, 80, 82, and 84. Belt 78 extends around belt pulleys 86 and 88; belt 80 extends around belt pulleys 90 and 92; belt 82 extends around belt pulleys 94 and 96; and belt 84 extends around belt pulleys 98 and 100. Pulleys 86, 90, 94, and 98 are mounted on shaft 102 which is drivingly connected to motor 104. Pulleys 88, 92, 96, and 100 are mounted on shaft 106. Shafts 102 and 106 are rotatably supported in end frames 108 and 110 by appropriate bearings (not shown) so as to permit free rotation of the shafts 102 and 106 and the pulleys supported thereby. Belts 78, 80, 82, and 84 extend across the top of a sheet support plate 112 which is attached to side frame elements 108 and 110. A sheet supplied to the sheet input, as shown in FIG. 2*a,* rests on top of belts 78, 80, 82, and 84 and, in the spaces between the belts, on top of plate 112.

In order to ensure that the sheet 72 is firmly engaged by the belts, the conveyor means further includes a plurality of spherical rollers 114 which rest on the belts and contact the sheet of paper therebeneath. The weight of the rollers 114 presses the sheet 72 downward against the belts. A means for retaining the spherical rollers 114 in position above the endless belts includes a plate 116, secured to end frame 110 by screws 118, and a cover plate 120, which is attached to plate 116 by means of hinges 122. For purposes of illustration, cover plate 120 is shown as transparent. Plate 116 and cover plate 120 define circular openings in which rollers 114 are positioned. The circular openings are slightly smaller in diameter than the spherical rollers 114. It should be noted that in FIGS. *2b*, *3b*, and *4b* the thickness of the sheet 72 is exaggerated for purposes of illustration. Actually, sheet 72 is typically extremely thin and spherical rollers 114 contact associated endless belts when a sheet is not interposed between rollers 114 and the belts.

Rollers 114 are free to rotate in any direction by virtue of their loose containment within retainers 124 which are attached to plate 116 and cover plate 120. Each of the retainers 124 has a pair of side fingers 126 and an upper finger 128 which holds spherical roller 114 generally in position, while permitting the roller 114 to rest on a sheet therebeneath and to rotate freely with the sheet as it moves in any direction.

As stated previously, motor 104 acts as a drive means which rotates shaft 102 and pulleys 86, 90, 94, and 98 mounted thereon. Belts 78, 80, 82, and 84 drive pulleys 88, 92, 96, 100, and supporting shaft 106. A sheet supplied to the sheet input 74 is therefore carried by the endless belt conveyor means to the sheet output 76.

Figure 5:
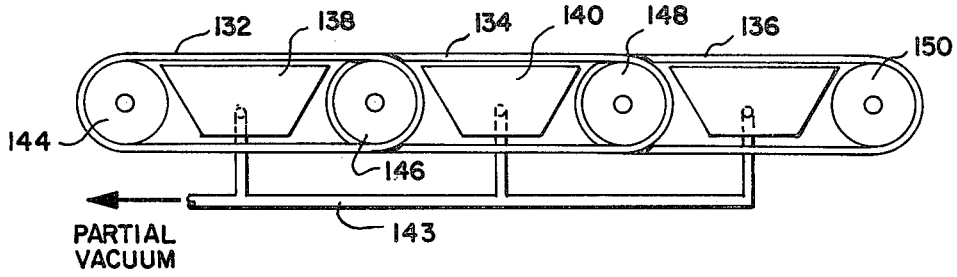
FIG. 5 is a sectional view taken generally along line 5—5 in FIG. 2.

End frame 110, as well as providing support for the shafts 102 and 106, also defines an alignment surface 130 which extends generally parallel to and to one side of belts 78, 80, 82, and 84. An alignment means includes a plurality of parallel vacuum belts 132, 134, and 136 and a series of vacuum plenums 138, 140, and 142 which are interconnected by vacuum line 143, as shown in FIG. 5, to form an effectively single vacuum plenum. Vacuum line 143 is also connected to a vacuum pump (not shown) which supplies a partial vacuum to plenums 138, 140, and 142. Belts 132, 134, and 136 are mounted on rollers 144, 146, 148, and 150 and extend upward through an opening 152 in plate 112 such that the top surfaces of the belts 132, 134, and 136 are substantially level with the top surfaces of belts 78, 80, 82, and 84. Vacuum belts 132, 134, and 136 are skewed with respect to endless belts 78, 80, 82, and 84 and preferably form an angle of approximately 30° therewith. The alignment means further includes spherical rollers 154 which are held in position in openings in cover plate 120 by retainers 156.

Each of the vacuum belts 132, 134, and 136 defines a plurality of openings 158 through which a partial vacuum from the plenums 138, 140, and 142 is applied to a sheet 72 supported thereon. The openings 158 are sufficient in size such that a sheet is not effectively engaged by belts 132, 134, and 136 unless the sheet is supported by all of the vacuum belts and covers substantially all of the openings. As described below more fully, this facilitates lateral shifting and alignment of the sheet 72 by the sheet registration device. In one device constructed according to the present invention belts 132, 134, and 136 each defined 3/16 inch openings equally spaced around the belt. The number of openings in each belt was such that eight openings were in communication with the associated vacuum plenum at any time. The vacuum pump communicating with line 143 was a Mini-Spiral pump, available from Rotron, Inc., Saugerties, N.Y., having a maximum flow rate of 3.5 scFm and a maximum vacuum of 3.5 iwg.

The drive means further includes means for driving the vacuum belts 132, 134, and 136. This drive means includes a belt 160 which extends between pulley 162, mounted on shaft 106, and pulley 164, mounted on shaft 166. Shaft 166 is connected to roller 144. As motor 104 drives endless belts 78, 80, 82, and 84, shaft 106 is rotated. Pulley 162 rotates and drives pulley 164 via belt 160 which extends around portions of idler pulleys 168, the upper of which is shown in FIGS. *2a*, *3a*, and *4a*. Belt roller 144 is rotated and drives belt 132, which in turn rotates roller 146, driving belt 134. In like manner, roller 148, driven by belt 134, drives belt 136. The sizes of pulleys 162 and 164 and rollers 144, 146, and 148 are selected such that the surface velocity of belts 132, 134, and 136 is greater than the surface velocity of belts 78, 80, 82, and 84.

Figure 6:
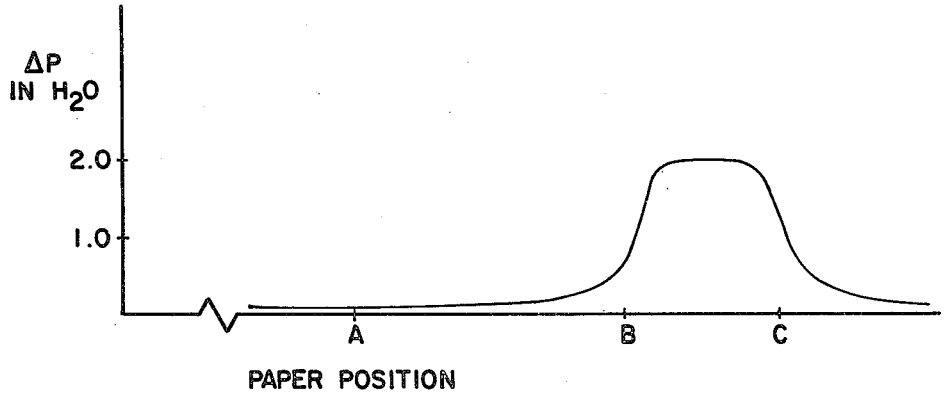
FIG. 6 is a graph illustrating the fluctuation in pressure in the vacuum plenum during the time in which a sheet moves through the registration device.

The operation of the sheet registration device and the manner in which it laterally aligns sheets prior to delivery of the sheets to the sheet output is described below. As seen in FIGS. *2a* and *2b*, sheet 72 is initially supplied to the sheet input of the device and is engaged by the belts 78, 80, 82, and 84 which translate it generally to the left. Although the leading edge of the sheet 72 covers a portion of the belts 132, 134, and 136, these belts do not provide significant lateral shifting of the sheet because the openings 158 in the belts are relatively large and vacuum plenums 138, 140, and 142 are interconnected as shown in FIG. 5. As a consequence, the partial vacuum supplied to these plenums is relieved through the uncovered openings 158 and the sheet 72 is not engaged by the alignment means. The pressure in plenums 138, 140, and 142 is approximately atmospheric pressure, as shown in FIG. 6 at A.

Sheet 72 is transported to the left until it reaches the position shown generally in FIGS. *3a* and *3b*. At this point, the sheet does cover substantially all of the openings 158. As a consequence, the partial vacuum within plenums 138, 140, and 142 is not relieved and the pressure within these plenums drops substantially, as shown in FIG. 6 at B. The suction applied to the bottom surface of the sheet 72 through openings 158 pulls the sheet 72 firmly against the top surfaces of the belts, and the sheet is then translated laterally by the vacuum belts simultaneously with its movement to the left by belts 78, 80, 82, and 84. The lateral edge of sheet 72 is moved into contact with the alignment surface 130, as shown in FIGS. *4a* and *4b*, and alignment of the sheet 72 is completed. Just following this alignment, the trailing edge of sheet 72 uncovers a number of the openings 158 on belt 136, with the result that the partial vacuum in the plenums 138, 140, and 142 is again relieved, and the pressure approaches atmospheric pressure, as shown in FIG. 6 at C. As a consequence, the belts 132, 134, and 136 are effectively disengaged from the sheet so that the sheet is therefore not forced against surface 130 to a degree which could cause curling or misalignment of the sheet.

By providing an alignment means including vacuum belts having relatively large openings, it will be appreciated that the lateral movement of the sheet 72 can be limited to a very short period of time. If belts having small vacuum openings, not sufficient to relieve the vacuum within the plenums, were to be used, this would result in a lateral shifting force being applied to the sheet for the entire time during which any portion of the sheet contacted any of the vacuum belts. An overshifting or misalignment of the sheet might result. It will be appreciated that the size of the openings 158 is dictated to an extent by the flow rate provided by the vacuum pump connected to line 143. If a higher capacity pump is selected, larger openings are required to insure that there is only a small pressure drop across one or more openings when they are not covered by a sheet. This, in turn, insures that the vacuum within the plenums is relieved.

It will be appreciated that it is desirable to provide a surface velocity for the belts 132, 134, and 136 which exceeds the surface velocity of the endless belts 78, 80, 82 and 84. Preferably, the velocity of belts 132, 134, and 136 is selected such that it has a velocity component in a direction parallel to the endless belts which is substantially equal to the surface velocity of the endless belts. Such an arrangement tends to prevent skewing of the sheets as they are shifted laterally against the alignment surface 130.

While the form of apparatus herein described constitutes a preferred embodiment of the invention, it is to be understood that the invention is not limited to this precise form of apparatus, and that changes may be made therein without departing from the scope of the invention.

What is claimed is:

1. A sheet registration device for receiving a sheet from a sheet input and delivering the sheet to a sheet output, while laterally aligning the sheet prior to delivery to said sheet output, comprising:

endless belt conveyor means, extending between said sheet input and said sheet output and including a plurality of endless belts, means defining an alignment surface extending generally parallel to and to one side of said endless belts, drive means for driving said endless belt conveyor means such that a sheet supplied to said endless belt conveyor means from said sheet input is carried by said belts to said sheet output, alignment means, including a plurality of parallel vacuum belts and a cooperating plenum, adjacent said endless belt conveyor means and skewed with respect to said endless belts, for engaging a sheet as it is carried by said endless belt conveyor means and for transporting the sheet laterally such that a lateral edge thereof contacts said adjacent surface, said vacuum belts defining a plurality of openings through which a partial vacuum from said plenum is applied to a sheet supported thereon, said openings being sufficient in size such that a sheet is not vacuum engaged unless the sheet is supported by all of said vacuum belts, and means for supplying a partial vacuum to said plenum.

2. The sheet registration device of claim 1 in which said plurality of parallel vacuum belts are skewed approximately 30° with respect to said endless belts.

3. The sheet registration device of claim 1 in which said endless belt conveyor means further comprises a plurality of spherical rollers, and means for retaining said spherical rollers in position above said endless belts and for pressing a sheet carried by said conveyor means against said endless belts.

4. The sheet registration device of claim 1 in which said alignment means further comprises:

a plurality of spherical rollers, and means for retaining said spherical rollers in position above said vacuum belts and for pressing a sheet carried by said conveyor means against said vacuum belts.

5. The sheet registration device of claim 1 in which said drive means further includes means for driving said plurality of parallel vacuum belts at a surface velocity greater than the surface velocity of said endless belts.

6. A sheet registration device, comprising:

conveyor means for transporting a sheet from a sheet input to a sheet output, means defining an alignment surface extending generally parallel and to one side of said conveyor means, and alignment means, including a vacuum belt transport extending at an angle to said conveyor means, for shifting a sheet carried by said conveyor means laterally into contact with said alignment surface, said vacuum belt transport including a plurality of parallel vacuum belts, each defining a plurality of vacuum openings, and a plurality of vacuum plenums, each such plenum cooperating with a respective one of said vacuum belts and interconnected to the others of said plenums to apply a sheet engaging suction to the bottom of a sheet through said openings, said vacuum openings being sized such that substantial vacuum is applied to a sheet only when substantially all of said openings cooperating with said plenums are covered by a sheet, whereby a sheet is engaged by said vacuum belts only when substantially all of said openings cooperating with said plenums are covered thereby.

7. The sheet registration device of claim 6 in which said conveyor means comprises:

a plurality of endless belts extending between said sheet input and said sheet output, a plurality of spherical rollers, and means for retaining said spherical rollers in position above said endless belts and for pressing a sheet thereagainst.

8. The sheet registration device of claim 6 in which said alignment further comprises a plurality of spherical rollers, and means for retaining said spherical rollers in position above said parallel vacuum belts and for pressing a sheet thereagainst.

* * * * *

UNITED STATES PATENT AND TRADEMARK OFFICE

CERTIFICATE OF CORRECTION

PATENT NO. : 4,440,389

DATED : April 3, 1984

INVENTOR(S) : Jack D. Ames, David W. Smith

It is certified that error appears in the above-identified patent and that said Letters Patent is hereby corrected as shown below:

Column 1, line 21, "developed" should be --developed.--.

Column 8, line 49, insert --means-- after "alignment".

Signed and Sealed this

*Nineteenth* Day of *June 1984*

(SEAL)

*Attest:*

GERALD J. MOSSINGHOFF

*Attesting Officer*

*Commissioner of Patents and Trademarks*